US006984139B1

(12) United States Patent
Lai

(10) Patent No.: US 6,984,139 B1
(45) Date of Patent: Jan. 10, 2006

(54) RECEPTACLE WITH PROTECTIVE CAP

(76) Inventor: Li-Chun Lai, 21F-1, No. 33, Sec.1, Minsheng Rd., Panciao City, Taipei County (TW)

( * ) Notice: Subject to any disclaimer, the term of this patent is extended or adjusted under 35 U.S.C. 154(b) by 0 days.

(21) Appl. No.: 11/111,925

(22) Filed: Apr. 22, 2005

(51) Int. Cl.
*H01R 13/44* (2006.01)

(52) U.S. Cl. ..... 439/142

(58) Field of Classification Search ..... 439/135, 439/136, 142, 143, 144, 145
See application file for complete search history.

(56) References Cited

U.S. PATENT DOCUMENTS 4,395,082 A * 7/1983 Rumble ..... 439/139
5,066,238 A * 11/1991 Shieh ..... 439/139
5,743,753 A * 4/1998 Yen ..... 439/143
5,842,878 A * 12/1998 Huag ..... 439/139
5,865,633 A * 2/1999 Hou ..... 439/139
5,866,846 A * 2/1999 Huag ..... 174/67
5,902,140 A * 5/1999 Cheung et al. ..... 439/139
5,997,319 A * 12/1999 Wu ..... 439/143
6,364,673 B1 * 4/2002 Lee ..... 439/139
6,406,308 B1 * 6/2002 Wang ..... 439/145
6,602,081 B1 * 8/2003 Wang ..... 439/145
6,764,322 B1 * 7/2004 Yu ..... 439/137
6,767,229 B1 * 7/2004 Wang ..... 439/145
2004/0203270 A1 * 10/2004 Wang ..... 439/136
2005/0020112 A1 * 1/2005 De Cell et al. ..... 439/135

* cited by examiner

*Primary Examiner*—Ross Gushi
(74) *Attorney, Agent, or Firm*—Dennison, Schultz, Dougherty & MacDonald

(57) ABSTRACT

A receptacle is provided with a rotatable protective cap, which is divided into two symmetrical cover plates so as to expose a power supply outlet if the receptacle proper for insertion of a load plug. When the receptacle is at rest, the cap is rotated to shade the power supply outlet so as to avoid ingress of foreign material and moisture that might cause electrical leakage, and also avoid possible contact of human fingers with the live parts of the receptacle that might cause fatal electrical shock.

7 Claims, 3 Drawing Sheets

RECEPTACLE WITH PROTECTIVE CAP

BACKGROUND OF THE INVENTION

1. Field of the Invention

The present invention relates to receptacle with protective cap, in particulars, to a receptacle which is equipped with a rotatable cap to shade the power outlet hole so as to avoid exposure of live parts and electrical leakage as well.

2. Description of the Prior Art

Generally, the electrical receptacles are classified a fixed type and a movable type. The fixed receptacle is installed fixedly in the wall of a building for supplying power to the electrical appliances. The movable receptacles, which is usually attached with an extension cord, can be conveniently moved to any desired places, either indoor or outdoor, with multiple outlets. However, both types of the above receptacles are uncovered when at rest so that the live poles are easily contaminated leading to hazardous electrical leakage. Besides, regularly exposed live poles from the outlet holes of the uncovered receptacle may cause a fatal electrical accident should there be innocent children who curiously insert their fingers into the outlet holes to touch the live poles.

For this defect noticeable on the conventional receptacles, an improvement is seriously required.

It is what the reason the inventor has put forth every effort for years by continuous research and experimentation attempting to find out the remedy to palliate the inherent shortcomings of the conventional receptacles described above, and finally has succeeded in coming out with the receptacle with a protective cap of the present invention.

SUMMARY OF THE INVENTION

The main object of the present invention is to provide a receptacle which is equipped with a protective cap so as to shut out ingress of foreign material and moisture into the live parts of the receptacle during the receptacle is at rest thereby avoiding electrical leakage.

Another object of the present invention is that hoping this protective cap can avoid children to insert their fingers accidentally or curiously into the receptacle's outlet holes to touch the live parts thereby causing hazardous electric shock.

To achieve the above objects, the receptacle of the present invention mainly includes a receptacle proper and a circular rotatable cap. The receptacle proper has a flesh plate and a round center cavity provided at its middle portion. Two insertion holes of a power outlet are located near the sides of the center cavity, and an axle seat is provided at its center and a C shaped guide slot is formed on the flash plate to encircle the axle seat. The rotatable cap which being rotatable fitted to an axle pin mounted on the axle seat is divided into two symmetrical segments each of them has a breach facing against each other so as to form each of the two segments into a cover plate, and the circumferential fringe of the cap is formed into a frictional serrated edge. When the cap rotated about the axle pin, a C shaped block provided at its bottom travels along the C shaped guide slot which limits the moving distance of the former until the insertion holes of the power supply outlet are emerged out of the breaches ready for accepting the insertion of the play of an electrical appliance. When the receptacle is not in use, the user may rotate the protective cap until the holes of the power outlet are shaded by the cover plated so as to avoid emerging of the hazardous live parts.

These features and advantages of the present invention will be fully understood and appreciated from the following detailed description of the accompanying Drawings.

DETAILED DESCRIPTION OF THE PREFERRED EMBODIMENT

Figure 1:
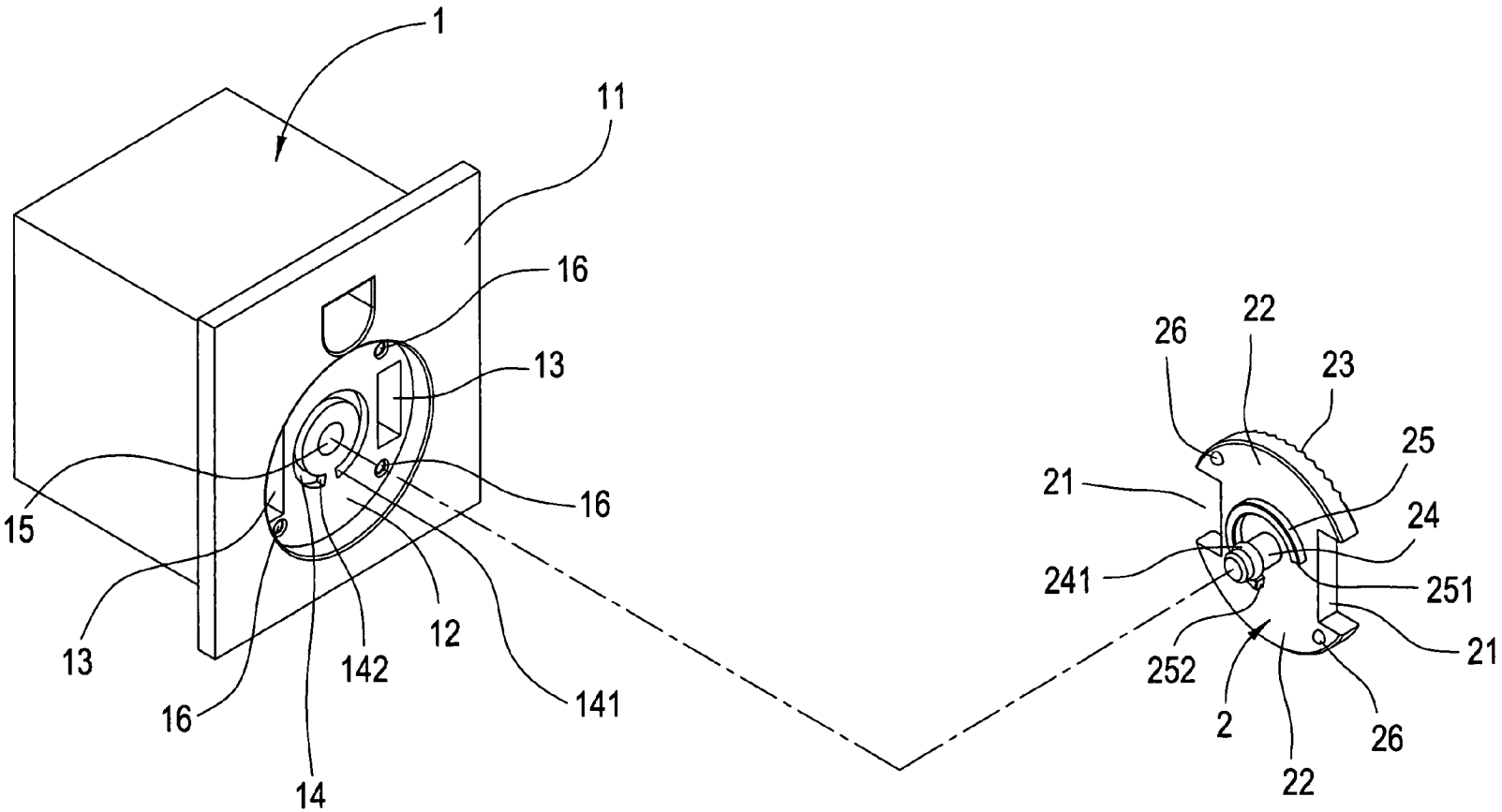
FIG. 1 is an exploded view of the receptacle of the present invention.
Figure 2:
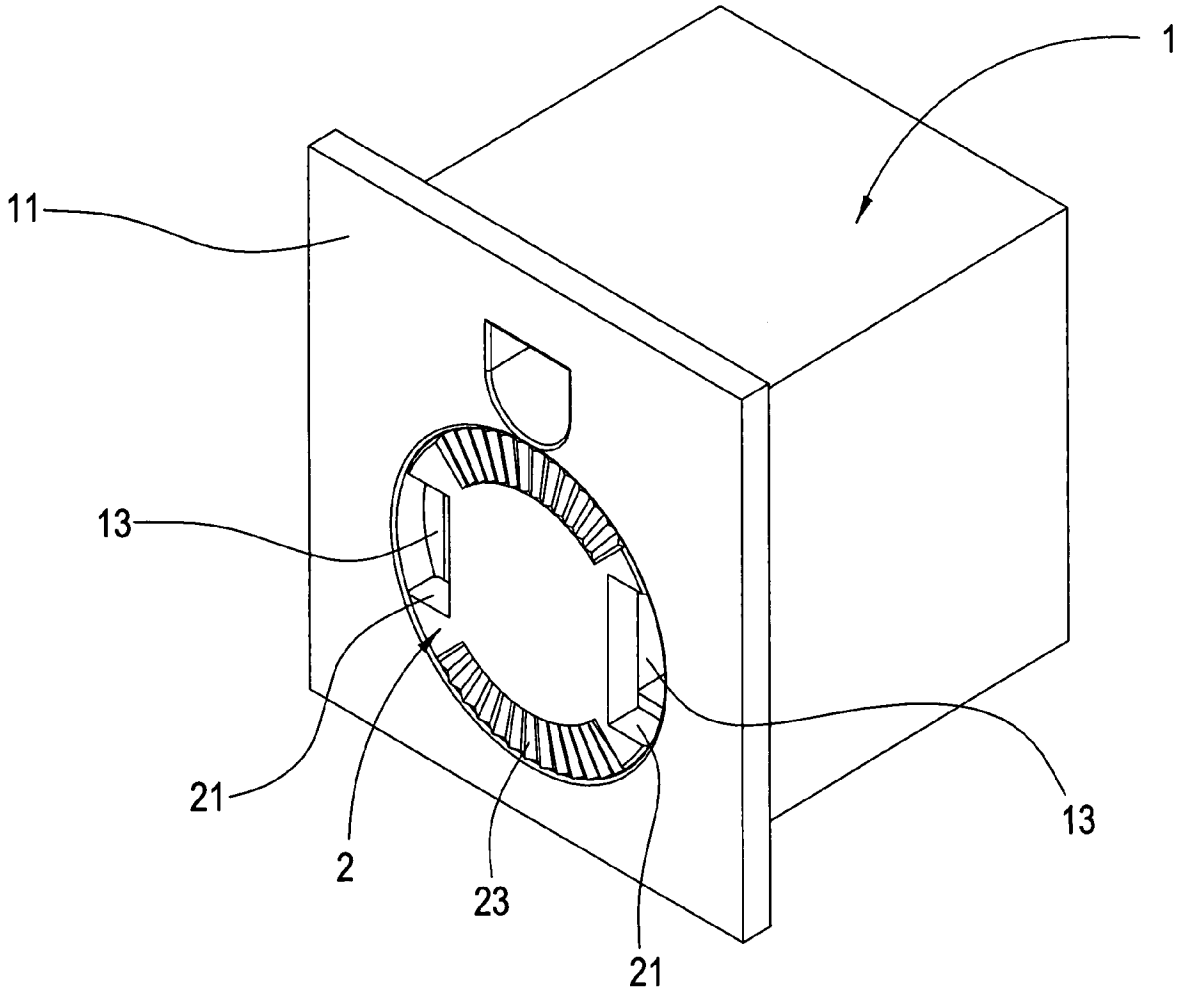
FIG. 2 is a three dimensional view of the receptacle of the present invention.

Referring to FIGS. 1 and 2, the receptacle of the present invention is mainly composed of a receptacle proper 1 and a circular rotatable cap 2.

The receptacle proper 1 has a flush plate 11 and a round center cavity provided at its middle portion. Two insertion holes of a power supply outlet 13 are located near the two sides of the center cavity 12, and an axle seat 15 is provided at its center and a C shaped guide slot 14 is formed on the flush plate 11 encircling the axle seat 15. The guide slot 14 has a first terminal 141 and a second terminal 142, and an indention 16 is formed at each of four end portions on the flush plate 11 of the receptacle proper 1 in the center cavity 12.

The circular rotatable cap 2, whose area is smaller than that of the center cavity 12 of the receptacle proper 1, is divided into two symmetrical segments each of them has a breach 21 facing against each other so as to form each of the two segments into a cover plate 22, and the circumferential fringe of the cap 2 is formed into a frictional serrated edge 23. An axle seat 15 is provide at the center position of the center cavity 12 for an axle pin 24 with a collar 241 encircled around near it's lower end to mount on. A C shaped block 25 with the length slightly shorter than that of the C shaped guide slot 14 of the receptacle proper 1, and having a first terminal 251 and a second terminal 252, is formed on the cover plated 22 of the cap 2 is a manner coaxially encircling the axle pin 24. A protuberance 26 is formed on the bottom of each cover plate 22 at both ends.

By fitting the axle pin 24 of the cap 2 on the axle seat 15 in the receptacle proper 1 in the center cavity 12, the collar 241 of the axle pin 24 serves to stably rest the cap 2 on the flush plate 11 or on the center cavity 12 of the receptacle proper 1 by mating with the axle seat. The C shaped block 25 slides in the C shaped guide slot 14 until its first terminal 251 mates with the first terminal 141 of the guide slot 14 but its second terminal 252 has not yet reached the second terminal 142 of the guide slot 14 by leaving a certain distance so as to emerge the both holes of the power outlet 13 out of the breaches 21 of the cap 2 thereby enabling to plug-in a load electrical appliance. Incidentally the protuberances 26 projected from the bottom of the cap 2 are captured by the corresponding indentions 16 such that the cap 2 is held fixedly at its position to expose the power supply outlet.

Figure 3A:
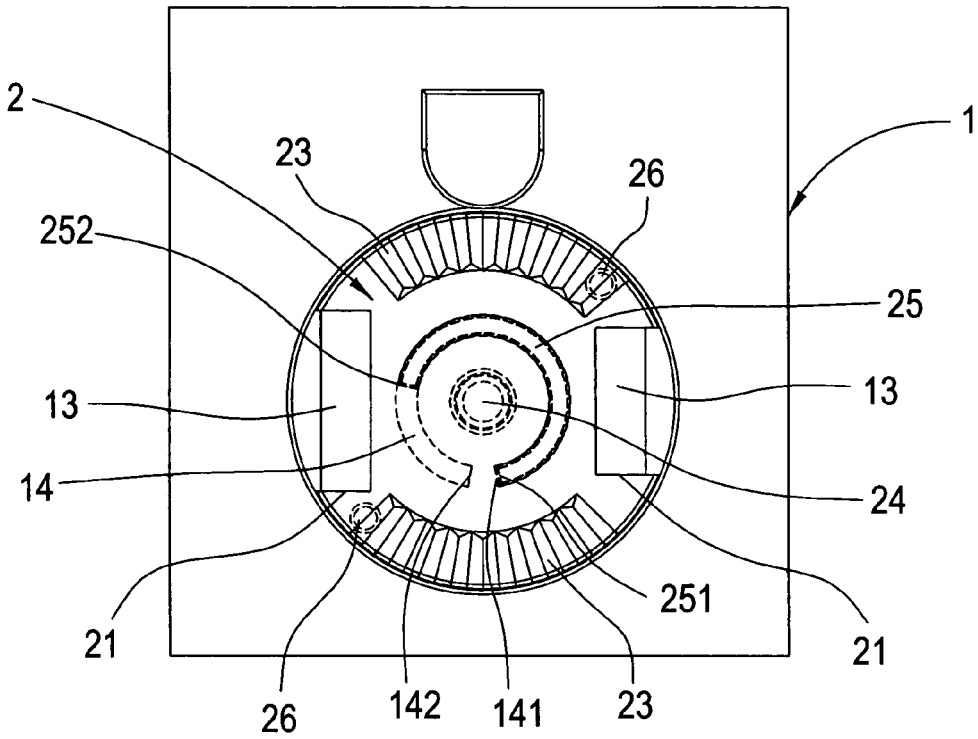
FIGS. 3A and 3B are illustrative views of the operation of the receptacle of the present invention.
Figure 3B:
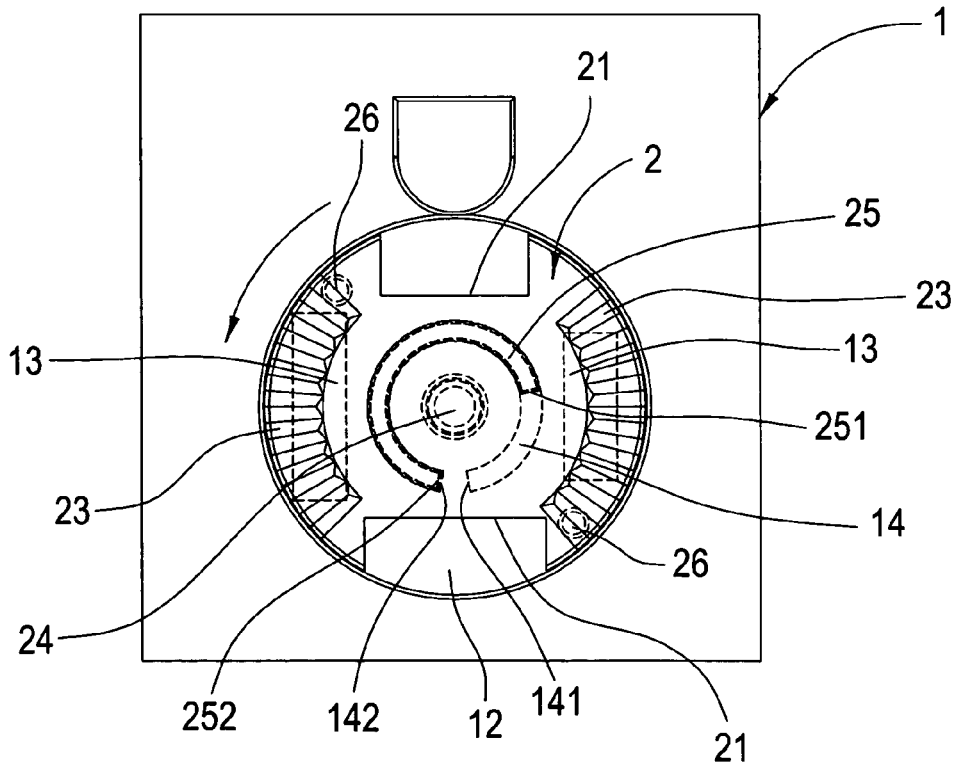

Referring to FIGS. 3A and 3B to understand the operation of the receptacle of the present invention. When a load plug is to be inserted to the receptacle, as shown in FIG. 3A, the power supply outlet 13 is emerged out of the breaches 21 as that described previously and need not be described again. When the receptacle is at rest, as shown in FIG. 3B, the cap 2 is turned with its frictional serrated edge 23 for a certain angle so as to mate the second terminal 252 of the C shape block 25 with the second terminal 142 of the C shaped guide slot 14 so as to shade both insertion holes of the power outlet 13 with both cover plates 22 of the cap 2. At this moment, the protuberances 26 projected from the bottom of the cap 2 are again captured in the corresponding indentions 16 such that the cap 2 is fixedly held at its position hat the foreign material and moisture or human fingers can not get into the power supply outlet thereby avoiding occurrence of possible electrical leakage or hazardous electrical shock.

In all, the receptacle with a protective cap provided by the present invention has several noteworthy merits such as 1. The rotatable protective cap can effectively shade the live parts of the receptacle when at rest so as to avoid ingress of foreign material and moisture therefore there is no worry about electrical leakage.
2. The protective cap shading the live parts of the receptacle when it is at rest well protect the children not to insert their fingers into the holes of the power outlet so that there is no worry about occurrence of electric shock.

Many changed and modifications in the above described embodiment of the invention can, of course, be carried out without departing from the scope there of. Accordingly, to promote the progress in science and the useful arts, the invention is disclosed is disclosed and is intended to be limited only by the scope of the appended claims.

What is claimed is:

1. A receptacle with protective cap comprising:

a receptacle proper and a circular rotatable protective cap;

Wherein said receptacle proper has flush plate and a round center cavity formed at its middle portion, two insertion holes of a power supply outlet are located near the two sides of said center cavity, and an axle seat is provided at its center and a guide slot is formed on said flush plate to encircle said axle seat, said guide slot has a first and a second terminals; said rotatable protective cap is divided into two symmetrical segments each of them has a breach facing against each other so as to form each of the two segments into a cover plate, an axle pin is mounted on said axle seat, a block formed on said cover plate is coaxial with said axle pin, said block has a first and a second terminals;

by fitting said axle pin of said cap on said axle seat in said receptacle proper, said cap is able to rotate on said flush plate about said axle pin, said block slides in said guide slot until its first terminal mates with the first terminal of said guide slot but its second terminal has not yet reached the second terminal of said guide slot by leaving a certain distance so as to emerge the both holes of said power supply outlet out of the breaches of said cap thereby enabling to plug-in a load electrical appliance.

2. The receptacle of claim 1, wherein said center cavity provided in said receptacle proper is for accommodating said rotatable protective cap, said power supply outlet, said guide slot, and said axle seat.

3. The receptacle of claim 1, wherein an indention is formed at each of four end portions on said flush plate of said receptacle proper, and a protuberance is formed on the bottom of each cover plate at both ends, by capturing said protuberances is said indentions correspondingly, said rotatable protective cap is held fixedly at its position to expose said power supply outlet ready for accepting a load plug.

4. The receptacle of claim 1 or 2, wherein an indention is formed at each of four end portions on said flush plate of said receptacle proper, and a protuberance is formed on the bottom of each cover plate at both ends, by capturing said protuberances in said corresponding indentions, said rotatable cap is held fixedly at it's position to shade said power supply outlet leaving said receptacle at rest.

5. The receptacle of claim 1, wherein the circumferential fringe of said rotatable protective cap is formed into a frictional serrated edge so as to facilitate rotating said cap to as desired position and stay stably there.

6. The receptacle of claim 1, wherein said axle pin has a collar encircling around near its lower end for serving to stably rest said rotatable protective cap on said flush plate of said receptacle proper by mating with said axle seat.

7. The receptacle of claim 1 or 2, wherein said axle pin has a collar encircling around near it's lower end for serving to stably rest said rotatable protective cap on said center cavity of said receptacle proper by mating with said axle seat.

* * * * *